US005634553A

United States Patent [19]

Hopper et al.

[11] Patent Number: 5,634,553

[45] Date of Patent: Jun. 3, 1997

[54] HANDLE ASSEMBLY HAVING SELF-ADJUSTABLE AXIAL LENGTH FOR COUPLING WITH DIFFERENT SIZE CIRCUIT BREAKERS

[75] Inventors: Douglas A. Hopper, Edwardsville, Ill.; Michael W. Miller, St. Louis, Mo.

[73] Assignee: Hubbell Incorporated, Orange, Conn.

[21] Appl. No.: 614,679

[22] Filed: Mar. 13, 1996

[51] Int. Cl.[6] ..... H01H 21/36

[52] U.S. Cl. ..... 200/336; 200/331

[58] Field of Search ..... 200/336, 331, 200/564; 74/504, 510

[56] References Cited

U.S. PATENT DOCUMENTS

| | | | |
|---|---|---|---|
| 4,154,991 | 5/1979 | Hickman et al. | 200/336 X |
| 4,597,681 | 7/1986 | Hodges | 200/331 X |
| 5,111,009 | 5/1992 | Chan et al. | 200/336 X |
| 5,326,949 | 7/1994 | Mannuss et al. | 200/336 |

*Primary Examiner*—Renee S. Luebke

*Attorney, Agent, or Firm*—Jerry M. Presson; Michael R. Swartz

[57] ABSTRACT

A handle assembly for use with a circuit breaker includes an elongated shaft mounted through a hole in a cover of an enclosure containing a circuit breaker having an actuator lever movable between a plurality of different positions. The shaft is mounted to the cover to undergo rotational movement about, but not translational movement along, a longitudinal axis of the shaft. The outer end portion of the shaft extends outwardly from an exterior side of the cover, while an inner end portion of the shaft extends inwardly from an interior side of the cover into the enclosure, terminating at a location spaced from the actuator lever of the circuit breaker in the enclosure. The handle assembly also includes a handle attached to the outer end portion of the shaft so as to undergo rotation with the shaft. The handle is adapted for gripping to rotate the handle and therewith the shaft about the longitudinal axis thereof, and a coupling mechanism for coupling with the actuator lever of the circuit breaker in the enclosure to move the actuator lever between the positions thereof upon rotation of the shaft by rotation of the handle. The coupling mechanism is mounted to the inner end portion of the shaft to undergo rotation with the shaft and translational movement relative to the shaft along the longitudinal axis thereof for adjusting the axial length of the handle assembly to reach respective actuator levers of circuit breakers when displaced at different distances from the cover of the enclosure.

26 Claims, 3 Drawing Sheets

HANDLE ASSEMBLY HAVING SELF-ADJUSTABLE AXIAL LENGTH FOR COUPLING WITH DIFFERENT SIZE CIRCUIT BREAKERS

BACKGROUND OF THE INVENTION

1. Field of the Invention

The present invention generally relates to circuit breakers disposed in explosion proof enclosures and, more particularly, is concerned with an operating handle assembly mounted through a cover of the enclosure and being adapted to self-adjust its axial length so that the same handle assembly can used to reach and switch different circuit breakers of varying sizes when located in the enclosure at different distances from the enclosure cover.

2. Description of the Prior Art

Circuit breakers of differing physical configurations and varying sizes as well as electrical load capacities are commonly used in conjunction with electrical circuits and equipment. These circuit breakers typically can be switched between plural positions, such as "on", "off" and "reset". It is not uncommon for flashing of electrical arcs to occur with the switching of circuit breakers.

In certain industrial applications, the circuit breakers must be located inside of an enclosure which has an explosion proof characteristic so as to isolate the circuit breakers and any electrical arcs they might create from the surrounding environment. In these applications, handles are commonly provided which extend from the exterior of the explosion-proof enclosures into the enclosures to the circuit breakers. Users can then operate the circuit breaker by gripping and pivoting the handle to move an actuator lever in order to switch the enclosed circuit breaker between its various positions without opening the enclosure. However, due to the fact that circuit breakers by different manufacturers vary from one another in size, handles of different axial lengths have had to be provided to accommodate the different size circuit breakers. This increases overall equipment cost by requiring different handles to be designed and manufactured to accommodate the different circuit breakers.

Consequently, a need exists to design a handle which will accommodate different sizes of circuit breakers and thereby overcome the aforementioned problem.

SUMMARY OF THE INVENTION

The present invention provides a handle assembly designed to satisfy the aforementioned needs. The handle assembly of the present invention has the capability to self-adjust its axial length in order to function with circuit breakers within a range of different heights and thus different distances from a cover of a circuit breaker enclosure mounting the handle assembly. Also, the handle assembly has the capability to self-lock at a particular desired axial length so as to prevent a coupling mechanism thereof which engages an actuator lever of the circuit breaker from retracting away from the actuator lever while moving between the "on", "off" and "reset" positions. Further, the mounting of the handle assembly through the cover of the explosion proof enclosure requires the provision of only one hole drilled and tapped through the cover.

Accordingly, the present invention is directed to a handle assembly for use with a circuit breaker assembly having an enclosure and a circuit breaker contained therein, the enclosure having a housing and a cover for closing an open side of the housing. The handle assembly is mounted on and extends through a hole in the cover of the enclosure and can be rotated at the exterior of the enclosure, without removing the cover, to move an actuator lever of the circuit breaker between its known plurality of positions, for example, "off", "on" and "reset".

The handle assembly comprises: (a) an elongated shaft defining a longitudinal axis and having an outer end portion, an inner end portion and an intermediate portion extending between and connected with the outer and inner end portions; (b) means for mounting the elongated shaft at its intermediate portion through the hole in the cover of the enclosure to undergo rotational movement relative to the cover about the longitudinal axis of the shaft but not undergo translational movement relative to the cover along the longitudinal axis of the shaft, the outer end portion of the shaft extending outwardly from an exterior side of the cover and the inner end portion of the shaft extending inwardly from an interior side of the cover into the enclosure and terminating at a location spaced from the actuator lever of the circuit breaker in the enclosure; (c) a handle attached to the outer end portion of the shaft so as to undergo rotation with the shaft, the handle being adapted for gripping to rotate the handle and therewith the shaft about the longitudinal axis thereof; and (d) means for coupling with the actuator lever of the circuit breaker in the enclosure to move the actuator lever between the plural positions thereof upon rotation of the shaft by rotation of the handle, the coupling means being mounted to the inner end portion of the shaft for undergoing rotation with the shaft and translational movement relative to the shaft along the longitudinal axis thereof for adjusting the axial length of the handle assembly in order to reach respective actuator levers of circuit breakers when displaced at different distances from the cover of the enclosure.

More particularly, the coupling means includes a hollow coupler sleeve inserted over the inner end portion of the shaft, means for mounting the coupler sleeve to the inner end portion of the shaft for undergoing rotation with the shaft and translational movement along the inner end portion of the shaft and along the longitudinal axis thereof, and means for engaging the coupler sleeve so as to cause the coupler sleeve to move translationally along the inner end portion of the shaft in a direction away from the outer end portion thereof so as to bias the coupler sleeve to maximize the axial length of the handle assembly in order to ensure that the coupler sleeve reaches the respective actuator lever of the given circuit breaker when displaced at different distances from the cover of the enclosure. In one exemplary form, the means for engaging the coupler sleeve is a resiliently flexible coiled spring. The means for mounting the coupler sleeve to the inner end portion of the shaft includes a side wall of the coupler sleeve containing at least one enclosed elongated slot formed by a pair of elongated opposite side edges defined in the side wall and laterally spaced from one another and extending substantially parallel to the longitudinal axis of the shaft and a pair of opposite end edges defined in the side wall and interconnecting corresponding opposite ends of the opposite side edges, and a pin extending transversely through the inner end portion of the shaft and having an end portion extending outwardly therefrom into the enclosed slot and being engageable with the opposite side edges thereof so as to prevent any substantial rotation of the coupler sleeve relative to the inner end portion of the shaft. The opposite end edges in the side wall of the coupler sleeve define a pair of opposite stops being engageable by the end portion of the pin so as to limit the extent of the translational movement of the coupler sleeve along the inner end portion of the shaft toward and away from the outer end portion thereof.

The coupling means further includes a trip plate having a mounting portion attached to the coupler sleeve and a bifurcated portion extending from the mounting portion and outwardly from the coupler sleeve. The bifurcated portion forms a pair of opposing lobes spaced apart from one another and defining a slot therebetween for receiving an end portion of the actuator lever of the circuit breaker so as to position the opposing lobes on opposite sides of the end portion of the actuator lever such that rotation of the coupler sleeve and the trip plate therewith upon rotation of the shaft will cause one or the other of the lobes to engage and move the actuator lever between the positions thereof depending upon the direction of rotation of the shaft. The opposite side edges in the side wall of the coupler sleeve have respective serrated configurations for grasping the end portion of the pin when the coupler sleeve is rotated by the pin with rotation of the shaft so as to prevent the coupler sleeve from moving translationally along the inner end portion of the shaft and thereby prevent the trip plate from moving away and disengaging from the end portion of the actuator lever during rotation of the shaft.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
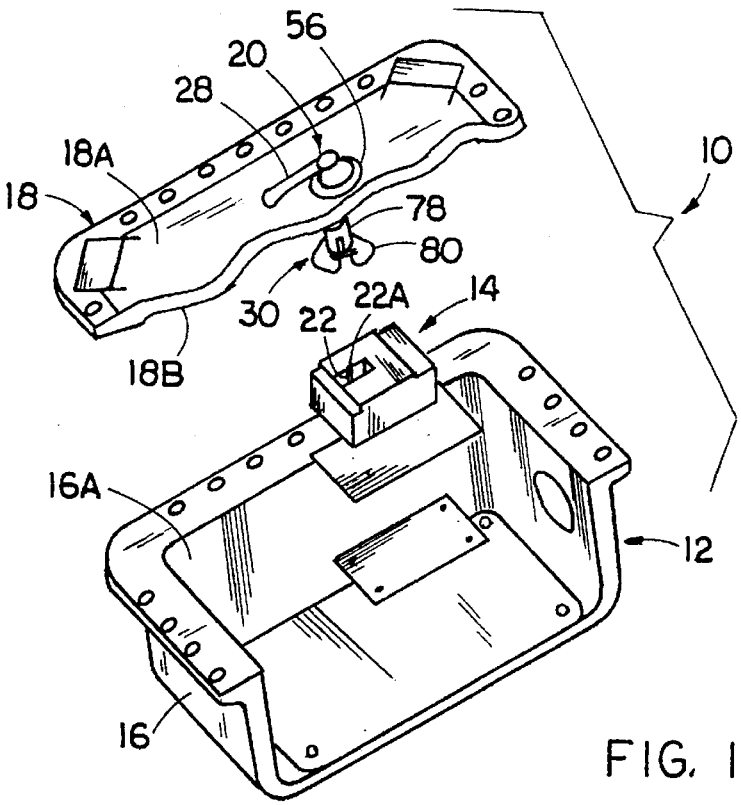
FIG. 1 is an exploded perspective view of a circuit breaker and enclosure of a circuit breaker assembly and a handle assembly of the present invention shown mounted on a cover of the circuit breaker enclosure.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 9:
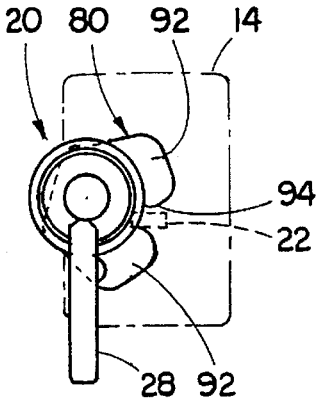
FIG. 9 is a top plan view of the handle assembly of FIG. 2 shown at a first angular position in which an actuator lever of the circuit breaker is in an "off" position.

Referring now to the drawings, and particularly to FIG. 1, there is illustrated a circuit breaker assembly, generally designated 10, having an enclosure 12 containing a circuit breaker 14. The enclosure 12 has a box-like housing 16 and a cover 18 adapted to attach to and close an open side 16A of the housing 16 in a known manner, such as by use of screws. In accordance with the present invention, a handle assembly 20 is provided so as to mount on and extend through a hole in the cover 18 of the enclosure 12. The handle assembly 20 is deployed such that, from the exterior of the enclosure 12 without removing the cover 18, an actuator lever 22 of the circuit breaker 14 enclosed within the enclosure 12 can be moved between its known plurality of operational positions, which typically are "off", "on" and "reset", as respectively shown in FIGS. 9, 10 and 11.

Figure 2:
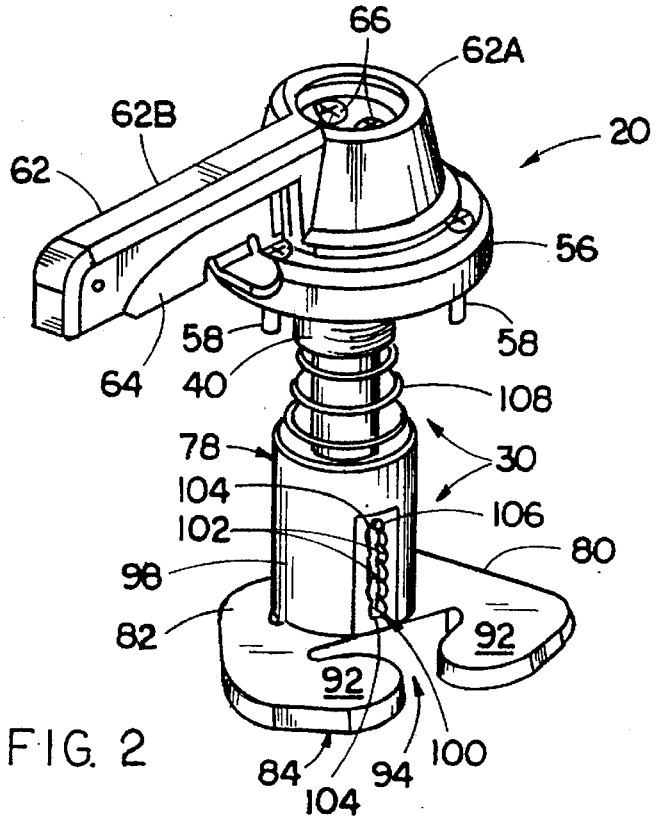
FIG. 2 is an enlarged perspective view of the handle assembly of the present invention by itself.
Figure 3:
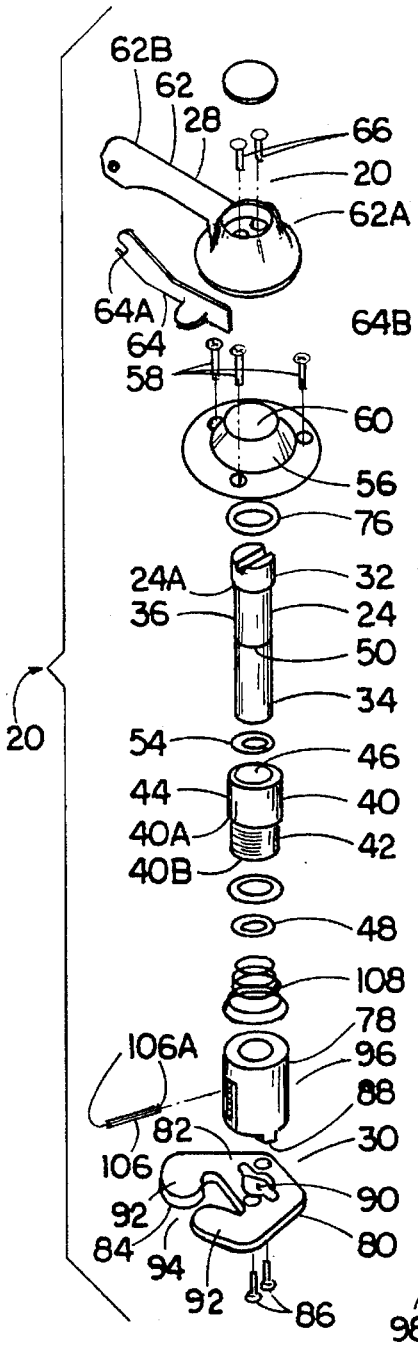
FIG. 3 is an exploded perspective view of the handle assembly.
Figure 6:
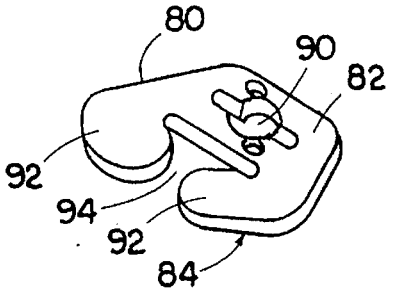
FIG. 6 is a perspective view of a trip plate of a coupling mechanism of the handle assembly of FIG. 3.
Figure 5:
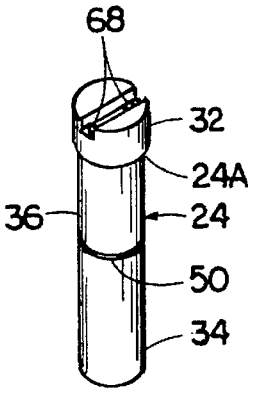
FIG. 5 is a perspective view of a central elongated shaft of the handle assembly of FIG. 3.
Figure 7:
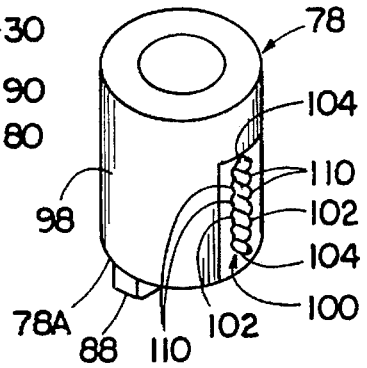
FIG. 7 is a perspective view of a coupler sleeve of the coupling mechanism of the handle assembly of FIG. 3.
Figure 8:
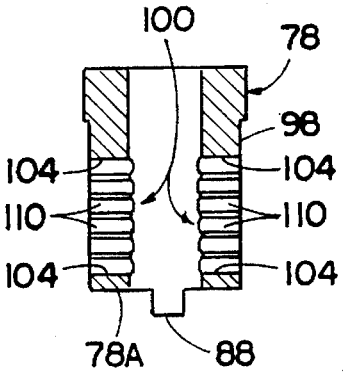
FIG. 8 is an axial sectional view of the coupler sleeve taken along line 8—8 of FIG. 7.
Figure 4:
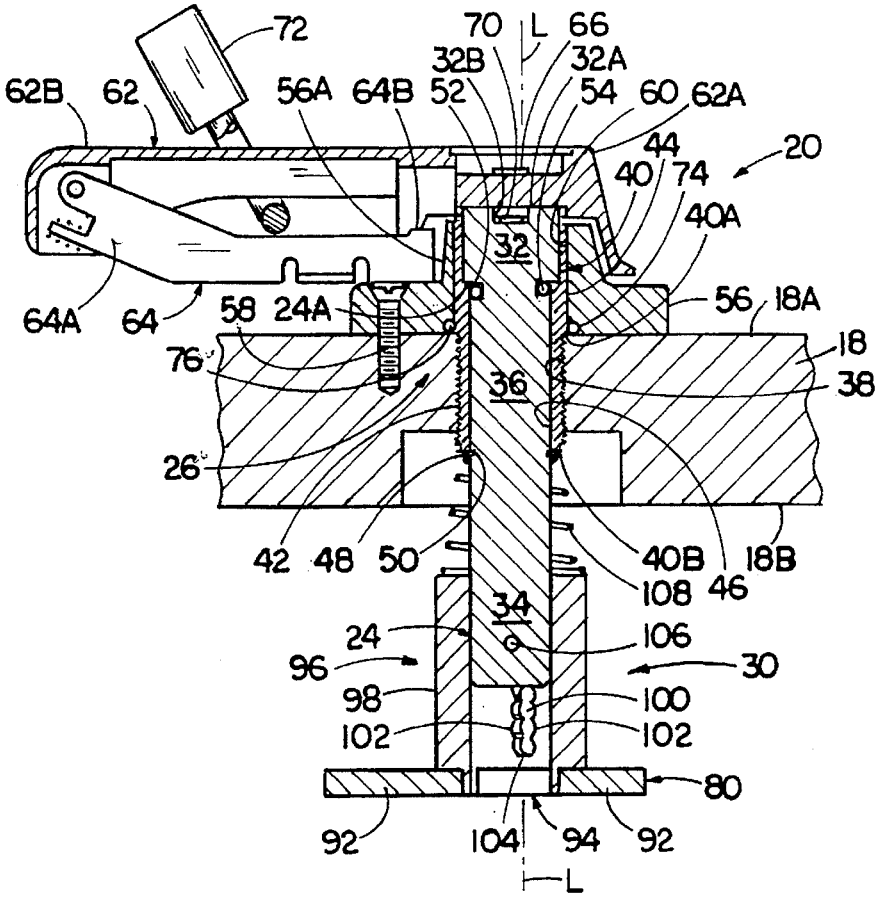
FIG. 4 is an enlarged axial sectional view of the handle assembly shown mounted on the enclosure cover.

Referring to FIGS. 2–4, the handle assembly 20 of the present invention basically includes an elongated shaft 24, a shaft mounting means or arrangement 26, a handle 28, and a coupling means or mechanism 30. The elongated shaft 24 of the handle assembly 20 is rotatably mounted through the cover 18 of the enclosure 12. The shaft 24 has a central longitudinal axis L and includes an outer end portion 32, an inner end portion 34 and an intermediate portion 36 extending between and connected with the outer and inner end portions 32, 34. The handle 28 of the handle assembly 20 is fixedly attached to the outer end portion 32 of the shaft 24 so as to undergo rotation with the shaft 24. The handle 28 is adapted to be gripped by a user to rotate the handle 28 and therewith the shaft 24 about its longitudinal axis thereof.

The shaft mounting means or arrangement 26 of the handle assembly 20 mounts the elongated shaft 24 at the intermediate portion 36 thereof through a hole 38 tapped in the cover 18 of the enclosure 12 containing the circuit breaker 14. As will be described below, the shaft mounting arrangement 26 supports the shaft 24 through the cover 18 so as to permit the shaft 24 to undergo rotational movement relative to the cover 18 about the longitudinal axis L of the shaft 24 but not undergo translational movement relative to the cover 18 along the longitudinal axis L of the shaft 24. The outer end portion 32 of the shaft 24 which mounts the handle 28 extends outwardly from an exterior side 18A of the cover 18, while the inner end portion 34 of the shaft 24 extends inwardly from an interior side 18B of the cover 18 into the enclosure 12, with the inner end portion 34 terminating at a location spaced from the actuator lever 22 of the circuit breaker 14 mounted in the enclosure 12.

More particularly, the shaft mounting means or arrangement 26 includes an annular bushing 40 having an externally threaded lower portion 42 which is threadably fitted through the internally threaded hole 38 in the cover to fixedly secure the annular bushing 40 to the cover 18. The annular bushing 40 also has a non-threaded upper portion 44 which extends outwardly from the exterior side 18A of the cover 18. The outer end portion 32 and intermediate portion 36 of the elongated shaft 24 are inserted through a central bore 46 of the annular bushing 40 and various interengaging elements provided by the shaft mounting means or arrangement 26 are disposed at spaced locations on the intermediate portion of the shaft 24 and at spaced locations on the annular bushing 40 so as to permit rotational movement of the shaft 24 about its longitudinal axis L relative to the cover 18 and annular bushing 40 but prevent translational movement of the shaft 24 along its longitudinal axis L relative to the cover 18 and annular bushing 40. In the exemplary embodiment shown in FIGS. 3 and 4, the interengaging elements include a pair of annular shoulders 24A, 40A defined respectively on the shaft 24 and annular bushing 40 which overlap and abut one another at first locations thereon. The interengaging elements further include an annular snap ring 48 removably secured to the shaft 24 by being mounted within an annular groove 50 defined in and about the shaft 24 at a second location spaced from the first location thereon. The snap ring 48 overlaps and abuts a bottom end 40B of the annular bushing 40. The shaft 24 also has an annular channel 52 defined therein adjacent to the annular shoulder 24A. The annular channel 52 seats an 0-ring 54, being made of resilient flexible material, which protrudes radially outwardly into sealing contact with the annular bushing 40 so as to provide a liquid tight seal preventing passage of fluids into and from the enclosure 12 between the exterior of the shaft 24 and interior of the annular bushing 40.

For mounting the handle 28 to the shaft 24, the shaft mounting means or arrangement 26 further includes an annular lock collar 56 attached on the exterior side 18A of the cover 18 by screws 58 so as to surround the hole 38 through the cover 18. The non-threaded upper portion 44 of the annular bushing 40 which extends along and about the outer end portion 32 of the shaft 24 is inserted therewith through a central bore 60 of the annular lock collar 56. The handle 28 has an upper main part 62 and a lower auxiliary part 64. The upper main part 62 is formed with an annular mounting portion 62A and a handle grip portion 62B rigidly connected to the annular mounting portion 62A and extending radially outwardly therefrom with respect to the longitudinal axis L of the shaft 24. The annular mounting portion 62A is attached to the top end 32A of the upper end portion 32 of the shaft 24 by screws 66 threaded into tapped holes 68 in the top end 32A of the shaft 24. Also, one or more lugs 70 protruding from the bottom side of the annular mounting portion 62A of the upper main part 62 of the handle 28 fit into a groove 32B extending across the top end 32A of the shaft 24 to prevent placing any torque on the attachment screws 66 when the handle 28 is turned to rotate the shaft 24 about its longitudinal axis L. The lower auxiliary part 64 of the handle 28 is pivotally mounted at its outer end 64A to the outer end of the handle grip portion 62B of upper main part 62 and extends at its inner end 64B into a radial slot 56A defined in the annular lock collar 56. As shown in FIG. 4, a padlock 72 is preferably employed to prevent lifting of the lower auxiliary part 64 toward the upper main part 62 such that the inner end 64B of the lower auxiliary part 64 will be moved from the radial slot 56A and clear the annular lock collar 56 so as to permit turning of the handle 28 relative to the cover 18. Thus, the handle 28 cannot be turned to rotate the shaft 24 until the padlock 72 is first removed. The lock collar 56 also has an annular channel 74 defined therein about the lower end of its central bore 60. The annular channel 74 seats an O-ring 76, being made of resilient flexible material, which protrudes radially inwardly into sealing contact with the annular bushing 40 so as to provide a liquid tight seal preventing passage of fluids into and from the enclosure 12 between the exterior of the annular bushing 40 and interior of the lock collar 56.

Referring to FIGS. 2–8, the coupling means or mechanism 30 of the handle assembly 20 couples the shaft 24 with the actuator lever 22 of the circuit breaker 14 in the enclosure 12 to move the actuator lever 22 between its operational positions upon rotation of the shaft 24 by turning or rotation of the handle 28. The coupling mechanism 30 is mounted to the inner end portion 34 of the shaft 24 for undergoing rotation with the shaft 24 and slidable movement relative to the shaft 24 along the longitudinal axis L thereof for adjusting the axial length of the handle assembly 20 to reach the respective actuator lever 22 of the given circuit breaker 14 when displaced at different distances from the cover 18 of the enclosure 12.

Figure 11:
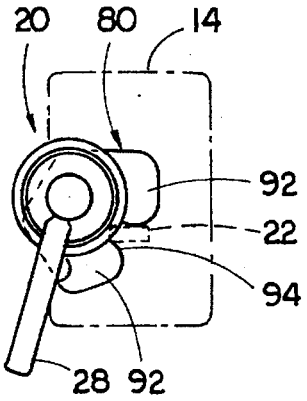
FIG. 11 is a view similar to that of FIG. 9, but showing the handle assembly at a third angular position in which the actuator lever of the circuit breaker is in a "reset" position.
Figure 10:
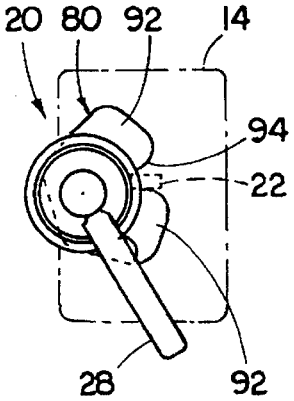
FIG. 10 is a view similar to that of FIG. 9, but showing the handle assembly at a second angular position in which the actuator lever of the circuit breaker is in an "on" position.

More particularly, the coupling mechanism 30 includes a hollow coupler sleeve 78 inserted over the inner end portion 34 of the shaft 24, and a trip plate 80 having a mounting portion 82 attached to the coupler sleeve 78 and a bifurcated portion 84 extending from the mounting portion 82 outwardly from the coupler sleeve 78 for coupling with an end portion 22A of the actuator lever 22. The coupling mechanism 30 further includes means in the form of screws 86 fixedly securing the mounting portion 82 of the trip plate 80 to the bottom 78A of the coupler sleeve 78 and one or more lugs 88 on the bottom 78A of the coupler sleeve 78 fitted within an opening 90 in the mounting portion 82 of the trip plate 80 for preventing the rotational torque of the coupler sleeve 78 from being applied to the attachment screws 86. The bifurcated portion 84 of the trip plate 80 forms a pair of opposing lobes 92 spaced apart from one another and defining a slot 94 therebetween for receiving the end portion 22A of the actuator lever 22 of the circuit breaker 14 so as to position the opposing lobes 92 on opposite sides of the end portion 22A of the actuator lever 22 such that rotation of the coupler sleeve 78 and of the trip plate 80 therewith upon rotation of the shaft 24 will cause one or the other of the lobes 92 to engage and move the actuator lever 22 between its plurality of operational positions depending upon the direction of rotation of the shaft 24. For example, in FIG. 9, the handle 28 is shown at a first angular, or 6 o'clock, position in which the trip plate 80 has disposed the actuator lever 22 of the circuit breaker 14 at the "off" position. In FIG. 10, the handle 28 is shown after having been turned or rotated counterclockwise from the first angular position of FIG. 9 to a second angular, or 5 o'clock, position in which the trip plate 80 has moved the actuator lever 22 to and now disposes it at the "on" position. In FIG. 11, the handle 28 is shown after having been turned or rotated clockwise from the second angular position of FIG. 10, past the first angular position of FIG. 9, to a third angular, or 7 o'clock, position in which the trip plate 80 has now moved the actuator lever 22 to and now disposes it at the "reset" position.

Still further, the coupling mechanism 30 includes means 96 for mounting the coupler sleeve 78 on the inner end portion 34 of the shaft 24 for undergoing rotation with the shaft 24 and also for undergoing translational movement along the inner end portion 34 of the shaft 24 and along the longitudinal axis L thereof to permit achievement of self-adjustment of the axial length of the handle assembly 20. The mounting means 96 includes a side wall 98 of the coupler sleeve 78 containing at least one and preferably a pair of opposite enclosed elongated slots 100 each formed by a pair of elongated opposite side edges 102 defined in the side wall 98 and laterally spaced from one another and extending generally parallel to the longitudinal axis L of the shaft 24 and a pair of opposite end edges 104 defined in the side wall 98 and interconnecting corresponding opposite ends of the side edges 102. The mounting means 96 also includes an elongated pin 106 extending transversely through the inner end portion 34 of the shaft 24 and having opposite end portions 106A extending outwardly therefrom into the respective enclosed slots 100 and thereby being engageable with the opposite side edges 102 thereof so as to prevent any substantial rotation of the coupler sleeve 78 relative to the inner end portion 34 of the shaft 24. The opposite end edges 104 defined in the side wall 98 of the coupler sleeve 78 provide a pair of opposite stops being engageable by the end portion 106A of the pin 106 so as to limit the extent of the reciprocal translational movement of the coupler sleeve 78 along the inner end portion 34 of the shaft 24 toward and away from the outer end portion 32 thereof.

The coupling mechanism 30 additionally includes means such as a resiliently flexible coiled spring 108 or a suitable equivalent element extending over the shaft 24 and compressed between the coupler sleeve 78 and the bottom end 40B of the annular bushing 40 or underside of the cover 18 for engaging the coupler sleeve 78 so as to cause it to translationally or linearly move along the inner end portion 34 of the shaft 24 in a direction away from the outer end portion 32 thereof so as to bias the coupler sleeve 78 to assume a position along the shaft 24 which maximizes the axial length of the handle assembly 20 in order to ensure that the trip plate 80 mounted to the bottom end 78A of the coupler sleeve 78 reaches the respective actuator lever 22 of the given circuit breaker 14 when displaced at different distances from the cover 18 of the enclosure 12.

In addition, preferably, the opposite side edges 102 in the side wall 98 of the coupler sleeve 78 have respective serrated configurations defining rows of arcuate concave depressions 110 in the side edges 102, as seen in FIGS. 2, 4, 7 and 8, or a suitable equivalent feature, for receiving and thereby grasping the end portion 106A of the pin 106 when the coupler sleeve 78 is rotated by the pin 106 with the shaft 24. This grasping action retains the pin 106 at the location of a given one of the depressions 110 along the slot 100 so as to prevent the coupler sleeve 78 from moving translationally along the longitudinal axis L of the inner end portion 34 of the shaft 24 toward the outer end portion 32 thereof and thereby prevents the trip plate 80 from "riding up" the end portion 22A of the actuator lever 22 and moving away and disengaging therefrom during the rotation of the shaft 24 by the external handle 28 which would result in the trip plate 80 failing to shift or switch the actuator lever 22 of the circuit breaker 14 between the various positions shown in FIGS. 9–11.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. A handle assembly for use with a circuit breaker assembly having an enclosure containing a circuit breaker and having a housing and a cover for closing an open side of the housing, said handle assembly comprising:

(a) an elongated shaft defining a longitudinal axis and having an outer end portion, an inner end portion and an intermediate portion extending between and connected with said outer and inner end portions;

(b) means for mounting said shaft at said intermediate portion thereof through an hole in a cover of an enclosure containing a circuit breaker, said mounting means permitting said shaft to undergo rotational movement about said longitudinal axis of said shaft but not to undergo translational movement along said longitudinal axis thereof, said outer end portion of said shaft extending outwardly from an exterior side of the cover and said inner end portion of said shaft extending inwardly from an interior side of the cover into said enclosure terminating at a location spaced from an actuator lever of the circuit breaker movable between a plurality of operational positions;

(c) a handle attached to said outer end portion of said shaft so as to undergo rotation with said shaft, said handle adapted for gripping to rotate said handle and therewith said shaft about said longitudinal axis thereof; and (d) means for coupling with the actuator lever of the circuit breaker in the enclosure to move the actuator lever between the operational positions thereof upon rotation of said shaft by rotation of said handle, said coupling means being mounted to said inner end portion of said shaft for undergoing rotation with said shaft and translational movement relative to said shaft along said longitudinal axis thereof for adjusting the axial length of said handle assembly in order to reach a respective actuator lever of a given circuit breaker when displaced at different distances from the cover of the enclosure.

2. The handle assembly as recited in claim 1, wherein said shaft mounting means includes:

an annular bushing for threadably fitting in the hole in the enclosure cover to fixedly secure the bushing to the cover, said elongated shaft at least at said intermediate portion thereof being inserted through a central bore of said bushing; and a plurality of interengaging elements disposed at spaced locations on said intermediate portion of said shaft and spaced locations on said annular bushing so as to permit rotational movement of said shaft about said longitudinal axis thereof relative to said annular bushing and prevent translational movement of said shaft along said longitudinal axis thereof relative to said annular bushing.

3. The handle assembly as recited in claim 2, wherein said interengaging elements include a pair of annular shoulders overlapping with and abutting one another, each defined on a respective one of said elongated shaft and said annular bushing at respective first locations thereon.

4. The handle assembly as recited in claim 3, wherein said interengaging elements further include an annular snap ring mounted about said elongated shaft at a second location on said shaft spaced from said first location thereon, said snap ring overlapping with and abutting an end of said annular bushing.

5. The handle assembly as recited in claim 2, wherein said shaft mounting means further includes an annular collar attachable on the exterior side of the cover so as to surround the hole through the cover, said annular bushing further extending along and about said outer end portion of said elongated shaft and being inserted therewith through a central bore of said annular collar.

6. The handle assembly as recited in claim 1, wherein said coupling means includes a trip plate being rotatable with rotation of said shaft and having a bifurcated portion forming a pair of opposing lobes spaced apart from one another and defining a slot therebetween for receiving an end portion of the actuator lever of the circuit breaker so as to position said opposing lobes on opposite sides of the end portion of the actuator lever such that rotation of said trip plate upon rotation of said shaft will cause one or the other of said lobes to engage and move the actuator lever between the positions thereof depending upon the direction of rotation of said shaft.

7. The handle assembly as recited in claim 1, wherein said coupling means includes:

a hollow coupler sleeve inserted over said inner end portion of said shaft;

means for mounting said coupler sleeve to said inner end portion of said shaft for undergoing rotation with said shaft and translational movement along said inner end portion of said shaft and along said longitudinal axis thereof; and means for engaging said coupler sleeve so as to cause said coupler sleeve to translationally move along said inner end portion of said shaft in a direction away from said outer end portion thereof so as to bias said coupler sleeve to maximize the axial length of said handle assembly in order to ensure that said coupler sleeve reaches the respective actuator lever of the given circuit breaker when displaced at different distances from the cover of the enclosure.

8. The handle assembly as recited in claim 7, wherein said means for engaging said coupler sleeve is a resiliently flexible coiled spring.

9. The handle assembly as recited in claim 7, wherein said means for mounting said coupler sleeve to said inner end portion of said shaft includes:

a side wall of said coupler sleeve containing an enclosed elongated slot formed by a pair of elongated opposite side edges defined in said side wall and laterally spaced from one another and a pair of opposite end edges defined in said side wall and interconnecting corresponding opposite ends of said side edges; and a pin extending transverse through said inner end portion of said shaft and having an end portion extending outwardly therefrom into said enclosed slot and being engageable with said opposite side edges thereof so as to prevent any substantial rotation of said coupler sleeve relative to said inner end portion of said shaft;

said opposite end edges in said side wall of said coupler sleeve defining a pair of opposite stops being engageable by said end portion of said pin so as to limit the extent of said translational movement of said coupler sleeve along said inner end portion of said shaft toward and away from said outer end portion thereof.

10. The handle assembly as recited in claim 9, wherein said coupling means further includes a trip plate having a mounting portion attached to said coupler sleeve and a bifurcated portion extending from said mounting portion and outwardly from said coupler sleeve, said bifurcated portion forming a pair of opposing lobes spaced apart from one another and defining a slot therebetween for receiving an end portion of the actuator lever of the circuit breaker so as to position said opposing lobes on opposite sides of the end portion of the actuator lever such that rotation of said coupler sleeve and said trip plate therewith upon rotation of said shaft will cause one or the other of said lobes to engage and move the actuator lever between the positions thereof depending upon the direction of rotation of said shaft.

11. The handle assembly as recited in claim 10, wherein said opposite side edges in said side wall of said coupler sleeve have respective serrated configurations for grasping said end portion of said pin when said coupler sleeve is rotated by said pin with said shaft so as to prevent said coupler sleeve from moving translationally along said inner end portion of said shaft and thereby prevent said trip plate from moving away and disengaging from the end portion of the actuator lever during rotation of said shaft.

12. The handle assembly as recited in claim 7, wherein said shaft mounting means includes:

an annular bushing for threadably fitting in the hole in the enclosure cover to fixedly secure said bushing to the cover, said elongated shaft at least at said intermediate portion thereof being inserted through a central bore of said bushing; and a plurality of interengaging elements disposed at spaced locations on said intermediate portion of said shaft and spaced locations on said annular bushing so as to permit rotational movement of said shaft about said longitudinal axis thereof relative to said annular bushing and prevent translational movement of said shaft along said longitudinal axis thereof relative to said annular bushing.

13. The handle assembly as recited in claim 12, wherein said shaft mounting means further includes an annular collar attachable on the exterior side of the cover so as to surround the hole through the cover, said annular bushing further extending along and about said outer end portion of said elongated shaft and being inserted therewith through a central bore of said annular collar.

14. In combination with a circuit breaker assembly having an enclosure and a circuit breaker in said enclosure having an actuator lever movable between a plurality of different positions, said enclosure having a housing and a cover for closing an open side of said housing, a handle assembly, comprising:

(a) an elongated shaft defining a longitudinal axis and having an outer end portion, an inner end portion and an intermediate portion extending between and connected with said outer and inner end portions;

(b) means for mounting said elongated shaft at said intermediate portion thereof through a hole in said cover of said enclosure, said mounting means permitting said shaft to undergo rotational movement relative to said cover about said longitudinal axis of said shaft but not undergo translational movement relative to said cover along said longitudinal axis of said shaft, said outer end portion of said shaft extending outwardly from an exterior side of said cover and said inner end portion of said shaft extending inwardly from an interior side of said cover into said enclosure terminating at a location spaced from said actuator lever of said circuit breaker in said enclosure;

(c) a handle attached to said outer end portion of said shaft so as to undergo rotation with said shaft, said handle adapted for gripping to rotate said handle and therewith said shaft about said longitudinal axis thereof; and (d) means for coupling with said actuator lever of said circuit breaker in said enclosure to move said actuator lever between said plurality of positions thereof upon rotation of said shaft by rotation of said handle, said coupling means being mounted to said inner end portion of said shaft for undergoing rotation with said shaft and translational movement relative to said shaft along said longitudinal axis thereof for adjusting the axial length of said handle assembly to reach a respective actuator lever of a given circuit breaker when displaced at different distances from said cover of said enclosure.

15. The combination as recited in claim 14, wherein said shaft mounting means includes:

an annular bushing threadably fitted in said hole in said enclosure cover so as to fixedly secure said annular bushing to said cover, said elongated shaft at least at said intermediate portion thereof being inserted through a central bore of said annular bushing; and a plurality of interengaging elements disposed at spaced locations on said intermediate portion of said shaft and spaced locations on said annular bushing so as to permit rotational movement of said shaft about said longitudinal axis thereof relative to said annular bushing and prevent translational movement of said shaft along said longitudinal axis thereof relative to said annular bushing.

16. The combination as recited in claim 15, wherein said interengaging elements include a pair of annular shoulders overlapping with and abutting one another, each defined on a respective one of said elongated shaft and said annular bushing at respective first locations thereon.

17. The combination as recited in claim 16, wherein said interengaging elements further include an annular snap ring mounted about said elongated shaft at a second location on said shaft spaced from said first location thereon, said snap ring overlapping with and abutting an end of said annular bushing.

18. The combination as recited in claim 15, wherein said shaft mounting means further includes an annular collar attachable on said exterior side of said cover so as to surround said hole through said cover, said annular bushing further extending along and about said outer end portion of said elongated shaft and being inserted therewith through a central bore of said annular collar.

19. The combination as recited in claim 14, wherein said coupling means includes a trip plate being rotatable with rotation of said shaft and having a bifurcated portion forming a pair of opposing lobes spaced apart from one another and defining a slot therebetween for receiving an end portion of the actuator lever of the circuit breaker so as to position said opposing lobes on opposite sides of the end portion of the actuator lever such that rotation of said trip plate upon rotation of said shaft will cause one or the other of said lobes to engage and move the actuator lever between the positions thereof depending upon the direction of rotation of said shaft.

20. The combination as recited in claim 14, wherein said coupling means includes:

a hollow coupler sleeve inserted over said inner end portion of said shaft;

means for mounting said coupler sleeve to said inner end portion of said shaft for undergoing rotation with said shaft and translational movement along said inner end portion of said shaft and along said longitudinal axis thereof; and means for engaging said coupler sleeve so as to cause said coupler sleeve to translationally move along said inner end portion of said shaft in a direction away from said outer end portion thereof so as to bias said coupler sleeve to maximize the axial length of said handle assembly in order to ensure that said coupler sleeve reaches the respective actuator lever of the given circuit breaker when displaced at different distances from the cover of the enclosure.

21. The combination as recited in claim 20, wherein said means for engaging said coupler sleeve is a resiliently flexible coiled spring.

22. The combination as recited in claim 20, wherein said means for mounting said coupler sleeve to said inner end portion of said shaft includes:

a side wall of said coupler sleeve containing an enclosed elongated slot formed by a pair of elongated opposite side edges defined in said side wall and laterally spaced from one another and a pair of opposite end edges defined in said side wall and interconnecting corresponding opposite ends of said side edges; and a pin extending transverse through said inner end portion of said shaft and having an end portion extending outwardly therefrom into said enclosed slot and being engageable with said opposite side edges thereof so as to prevent any substantial rotation of said coupler sleeve relative to said inner end portion of said shaft;

said opposite end edges in said side wall of said coupler sleeve defining a pair of opposite stops being engageable by said end portion of said pin so as to limit the extent of said translational movement of said coupler sleeve along said inner end portion of said shaft toward and away from said outer end portion thereof.

23. The combination as recited in claim 22, wherein said coupling means further includes a trip plate having a mounting portion attached to said coupler sleeve and a bifurcated portion extending from said mounting portion and outwardly from said coupler sleeve, said bifurcated portion forming a pair of opposing lobes spaced apart from one another and defining a slot therebetween for receiving an end portion of said actuator lever of said circuit breaker so as to position said opposing lobes on opposite sides of said end portion of said actuator lever such that rotation of said coupler sleeve and said trip plate therewith upon rotation of said shaft will cause one or the other of said lobes to engage and move said actuator lever between said positions thereof depending upon the direction of rotation of said shaft.

24. The combination as recited in claim 23, wherein said opposite side edges in said side wall of said coupler sleeve have respective serrated configurations for grasping said end portion of said pin when said coupler sleeve is rotated by said pin with said shaft so as to prevent said coupler sleeve from moving translationally along said inner end portion of said shaft and thereby prevent said trip plate from moving away and disengaging from said end portion of said actuator lever during rotation of said shaft.

25. The combination as recited in claim 20, wherein said shaft mounting means includes:

an annular bushing for threadably fitting in said hole in said enclosure cover to fixedly secure said annular bushing to said cover, said elongated shaft at least at said intermediate portion thereof being inserted through a central bore of said annular bushing; and a plurality of interengaging elements disposed at spaced locations on said intermediate portion of said shaft and spaced locations on said annular bushing so as to permit rotational movement of said shaft about said longitudinal axis thereof relative to said annular bushing and prevent translational movement of said shaft along said longitudinal axis thereof relative to said annular bushing.

26. The combination as recited in claim 25, wherein said shaft mounting means further includes an annular collar attachable on said exterior side of said cover so as to surround said hole through said cover, said annular bushing further extending along and about said outer end portion of said elongated shaft and being inserted therewith through a central bore of said annular collar.

* * * * *